US010842217B2

(12) United States Patent
Smallwood

(10) Patent No.: US 10,842,217 B2
(45) Date of Patent: Nov. 24, 2020

(54) HELMET

(71) Applicant: Ioan Smallwood, Cardiff (GB)

(72) Inventor: Ioan Smallwood, Cardiff (GB)

( * ) Notice: Subject to any disclaimer, the term of this patent is extended or adjusted under 35 U.S.C. 154(b) by 66 days.

(21) Appl. No.: 15/664,561

(22) Filed: Jul. 31, 2017

(65) Prior Publication Data

US 2018/0027916 A1 Feb. 1, 2018

(30) Foreign Application Priority Data

Jul. 29, 2016 (GB) ..... 1613127.8

(51) Int. Cl.
*A42B 3/22* (2006.01)
*A42B 3/12* (2006.01)

(52) U.S. Cl.
CPC ..... *A42B 3/223* (2013.01); *A42B 3/12* (2013.01); *A42B 3/222* (2013.01)

(58) Field of Classification Search
CPC ..... A42B 3/223; A42B 3/326; A42B 3/224; A42B 3/228; A42B 3/22; A42B 3/225; A42B 3/227; A42B 3/328
USPC ..... 2/6.1, 6.3, 6.5, 6.7, 8.3, 12, 15, 424
See application file for complete search history.

(56) References Cited

U.S. PATENT DOCUMENTS 3,517,392 A * 6/1970 Hodge ..... A61F 9/061 2/8.3
4,689,836 A 9/1987 Vitaloni
5,297,297 A * 3/1994 Pei ..... A42B 3/222 2/424
6,023,784 A * 2/2000 Yeal ..... A42B 1/064 2/12
6,370,700 B1 * 4/2002 Arion ..... A42B 3/224 2/424
6,795,978 B2 * 9/2004 Fournier ..... A42B 3/10 2/424
8,237,627 B2 * 8/2012 Nakabayashi ..... G02B 27/0176 2/414
2008/0276355 A1 * 11/2008 Lawrence ..... A42B 3/221 2/424
2011/0067158 A1 * 3/2011 Lee ..... A42B 3/226 2/15

(Continued)

FOREIGN PATENT DOCUMENTS

CA 2124780 A1 * 12/1995 ..... A42B 3/222
DE 202015106414 U1 12/2015

(Continued)

OTHER PUBLICATIONS

GB Search Report for patent application No. GB I613127.8 dated Sep. 29, 2016.

*Primary Examiner* — Clinton T Ostrup
*Assistant Examiner* — Patrick J. Lynch
(74) *Attorney, Agent, or Firm* — Fish IP Law, LLP

(57) ABSTRACT

A helmet having a visor and a method of manufacturing such helmet are disclosed. The helmet comprises a shell dimensioned to receive the head of a user. A visor is moveably attached to the shell, and configurable between (1) a first position in which the visor extends from a forward region of the shell and (2) a second position in which the visor is substantially retracted with respect to the forward region of the shell. It is contemplated that actuation of the movement of the visor between the first position and the second position is automated on placement or removal of the helmet from the head of a user.

16 Claims, 10 Drawing Sheets

(56) References Cited

U.S. PATENT DOCUMENTS

| | | | | |
|---|---|---|---|---|
| 2011/0154551 | A1* | 6/2011 | Spink | A42B 3/223 2/10 |
| 2011/0277224 | A1* | 11/2011 | Okuma | A42B 3/225 2/424 |
| 2016/0227866 | A1* | 8/2016 | Tal | H04N 5/23293 |

FOREIGN PATENT DOCUMENTS

| | | | | |
|---|---|---|---|---|
| EP | 0088344 | A2 * | 9/1983 | A42B 3/224 |
| EP | 0972461 | A1 * | 1/2000 | A42B 3/326 |
| FR | 2402455 | A1 * | 4/1979 | A42B 3/222 |
| GB | 1148019 | A | 4/1969 | |
| GB | 2409961 | A | 7/2005 | |

* cited by examiner

HELMET

PRIORITY CLAIM

This application claims priority to Great Britain application No. 1613127.8, filed Jul. 29, 2016.

FIELD OF THE INVENTION

This invention relates to a helmet, in particular a bicycle helmet with a retractable visor.

BACKGROUND

It is known for cyclists to wear a bicycle helmet as a protective measure, for instance a helmet may substantially reduce the incidence and severity of head injuries in the case of an accident. The helmet attenuates impact to the head of the user. It is important that the helmets are lightweight whilst providing the correct standard of protection. It is also important that a helmet does not obstruct the view of the user otherwise the helmet itself may be the cause of an accident. Therefore, known helmets are designed to minimise the interference with peripheral vision. Typical helmets comprise an outer shell and a liner formed of an impact absorbing element, for example a foamed polymer lines such as expanded polystyrene (EPS). The outer shell is usually made from a composite material having a fairly rigid structure. The helmet is shaped to receive the head of a user and can be secured by means of a strap at the rear of the helmet as well as under the chin.

As impact occurs, the expanded polystyrene liner is crushed thereby dissipating the energy over a rapidly increasing area like a cone.

Whilst such a helmet is configured to protect the head of a person in situations involving simple, low speed falls, there is no protection afforded to a persons eyes. The eyes are particularly vulnerable when a person is riding at speed, when it is raining or snowing or another adverse weather condition, or when parts from the road surface are lifted towards the face of the cyclist.

It is known for a cyclist to wear glasses so as to protect their eyes, however these are a separate and distinct elements that can be easily misplaced and are usually fragile and easily breakable. Further, rain can get on the inside of the lens and can enter the cyclist eyes.

Therefore, as an alternative eye protector the helmet may comprise a visor. The visor is usually formed of a polycarbonate and is transparent to enable the user to see therethrough. Alternatively, the visor may be coated to provide a shading effect to the eyes and to protect them from UV radiation. The visor is usually moveable between a working state and a stored state. In the working state the visor is positioned in front of the wearer's eyes so as to shield them. In the stored state, the visor is retracted above the wearer's forehead so as to prevent the lens from getting scratched and to make the helmet smaller to carry in a bag. Whilst it is desirable to configure the visor in the stored state when it is not in use, the user may not always remember to do so and when the visor is down it can be knocked and marked. These marks can be detrimental to the vision of the user.

SUMMARY OF THE INVENTION

The present invention is derived from the realisation that there exists the need to provide a helmet that meets the required safety standards, which improves the visibility of a user and which includes a retractable visor which does not require the user to select the retracted state.

Therefore, the present invention and its embodiments addresses the above described problems and desires.

According to a first aspect of the invention there is provided a helmet comprising:

a rigid shell dimensioned to receive the head of a wearer;

a visor moveably attached to the shell and configurable between a first position in which the visor extends from a forward region of the shell and a second position in which the visor is substantially retracted with respect to the forward region of the shell, wherein actuation of the movement of the visor between the first position and the second position is automated on removal of the helmet from the head of a user.

In the first position, the visor may be positioned in front of the eyes of the wearer.

The visor may comprise a recessed portion for framing the nose of a wearer

The helmet may further comprise a shield portion located at the forward region of the shell for providing a shielding effect to the surface of the visor when it is in the second position so as to protect the outer surface of the visor.

The helmet may comprise an actuator located internally to the shell and moveable between a first configuration where the head of the user is remote from the rigid shell and a second configuration where the head of a user is received by the rigid shell such that contact is made between the actuator and the head of the wearer.

The actuator may be shaped to follow the contour of at least a portion of the users head.

In the first configuration the distance between the uppermost surface of the actuator and the inner surface of the shell may be greater than the corresponding distance in the second configuration.

In use the users head may come into contact with the actuator and the resulting force applied thereto causes the actuator to move towards the inner surface of the shell thereby reducing the distance between the actuator and the inner surface of the shell.

The actuator may be in mechanical communication with the visor such that movement of the visor may occur in response to movement of the actuator between the first and second configuration or vice versa.

The helmet may further comprise a biasing member configured to bias the actuator in the first configuration when the head of the user is removed from the shell such that the visor is biased in the second position.

The biasing member may be a resilient member, for example a spring.

One end of the biasing member may be mechanically connected to the actuator and the other end of the biasing member is mechanically connected to the shell.

The actuator may comprise a lever portion extending from a pivotable portion that is configured to be moveable with respect to the shell.

The visor may be attached to the shell at a first pivot point and a second pivot point, the first pivot point may be spaced apart from the second pivot point such that in use the first pivot point and the second pivot point may be positioned either side of the head of the user.

At the first and/or second pivot point there may be configured a lockable hinge system, the lockable hinge system may comprise a pivotable part and a cooperable locking plate.

The lockable hinge system may further comprise a main body attachable to the shell for securing the visor, pivotable part and the locking plate.

The lockable hinge system may be configured to permit a rotational movement of the visor within a predetermined range.

The range of movement of the hinge system may be provided by a female portion located on the pivotable part being cooperable with a male portion located on the main body or vice versa.

The female portion may comprise a shaped profile the cross section of which comprises a first and second sector of a circle diametrically opposed to each other and extending from a central circular portion.

The male part may have the same shape as the female part, but differ in that the arc of the sector of the circle of the male part may be less than the arc of the sector of the circle of the female part.

The pivotable part may comprise a main disc portion from which may extend a male part from a first and second side thereof.

A cylindrical boss may extend from the centre of one of the male parts.

One of the male parts may be cooperable with a corresponding female aperture located within the lockable portion.

The cylindrical boss may be cooperable with an aperture located within the visor and the main body.

An elongate portion may extend radially from the pivot portion such that the elongate portion is directed towards the inner surface of the shell of the helmet.

A protrusion may extend diametrically opposite from the elongate portion.

One side of the main body may be connected to the shell of the helmet so as to anchor the hinge system to the shell.

The lockable part may be disposed between the pivotable part and a connecting portion of the visor.

The locking part may have a surface of corrugated teeth. Likewise the pivotable part may have a surface of corrugated teeth.

The pivotable part, locking part, and a connection region of the visor may be located within a channel provided between a first and second side wall of the main body.

One side of the pivotable part may be cooperable with a side of the main body and the other side of the pivotable part may be cooperable with the locking member and the visor.

One end of the biasing member may be attached to the protrusion and the other end of the biasing member may be attached to the main body.

The pivotable part may be rotatable with respect to the main body.

In use rotation of the pivotable part may cause rotation of the lockable part and the visor.

The lockable part and the visor may be attached together by at least one protrusion located on the lockable part and at least one aperture or recess located on the connecting portion of the visor, or vice versa.

The helmet may further comprise an override mechanism which may comprise a resilient member arranged between the pivotable member and the locking plate, the override mechanism may be configurable between a first state in which the surfaces of the pivotable member and the locking plate are brought together and a second state in which the surfaces of the pivotable member and the locking plate are arranged to permit the relative movement between the locking plate and the pivotable member.

The helmet may further comprise an actuator for selecting between the first state and the second state.

The actuator may be a pushable button in mechanical communication with the pivotable member.

The pushable button may be located on the outer surface of the hinge system and is in mechanical communication with the pivotable part so as to cause separation between the pivotable part and the lockable plate.

The youngs modulus of the resilient member located on the first connection point may differ to the youngs modulus of the resilient member located on the second connection point. For example, the youngs modulus of the first resilient member may be significantly less than the youngs modulus of the second resilient member or vice versa. The resilient member may be a spring.

The visor may be formed of polycarbonate.

The visor may further comprise a hydrophobic coating on its external surface.

The visor may further comprise a layer of glass on the outer surface of the visor, on which the hydrophobic material may be applied.

There may also be provided at least one LED light directed towards a rearward and/or forward region of the cyclist.

The helmet may comprise a first and second support arm positionable forwardly of the cyclist's ears so as to block the wind and noise incident on the ears of the cyclist.

The outside surface of the support arms may have a patterned or rough edge so as to act as air turbulence generators prior to the air reaching the users ears.

In a second embodiment of the invention there may be provided a method of manufacturing a helmet comprising forming the external surface of the shell;

applying the shock absorbing material to the inner surface of the shell; applying a shielding portion to the forward region of the shell; arranging the visor between the external surface of the shell and the inner surface of the shielding portion; attaching a lockable hinge system to the internal surface of the helmet and attaching the connection portion of the visor thereto.

In a third embodiment of the invention there may be provided a first and second connectable hinge, at least one hinge comprising an anchor part having a clip that may be attached to the helmet, a locking part may be attached to the visor and a pivotable part may be disposed between the anchor part and the locking part, wherein the pivotable part may be rotationally moveable with respect to the anchor part when the clip is attached to a helmet.

Whilst the invention has been disclosed above it extends to any inventive combination of the features set out above, or in the following description, drawings or claims. The invention will now be described, by way of example only, with reference to the accompanying drawings.

DETAILED DESCRIPTION

Figure 1:
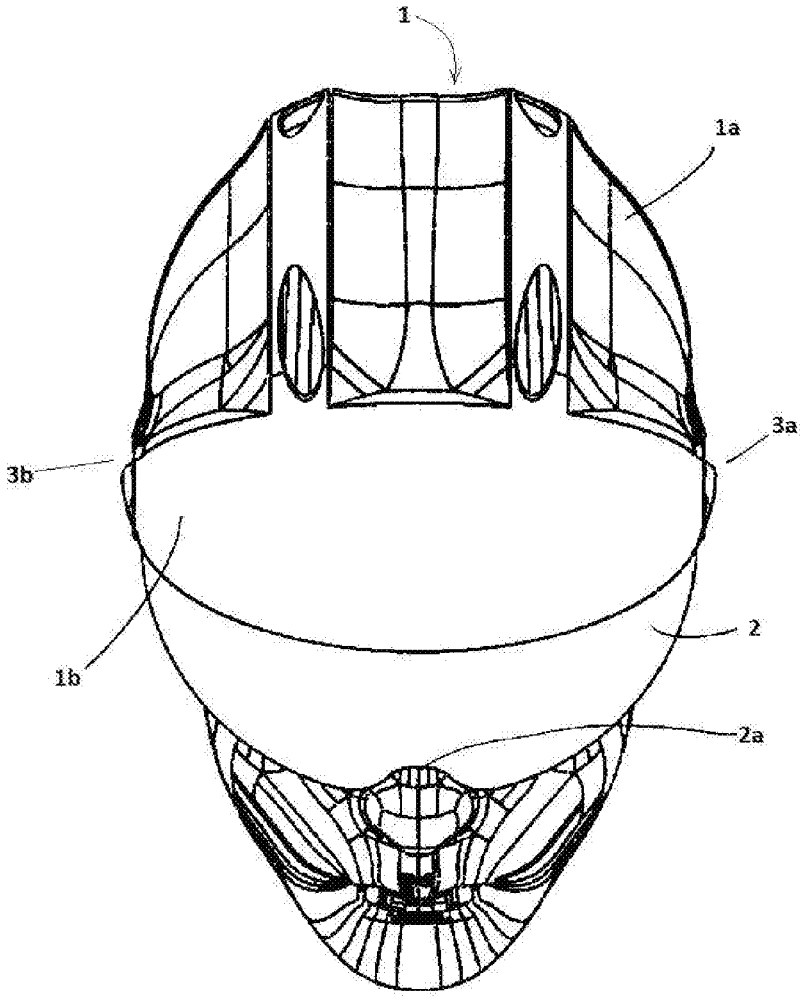
FIG. 1 is a front view of the helmet with the visor in the operable state.
Figure 2:
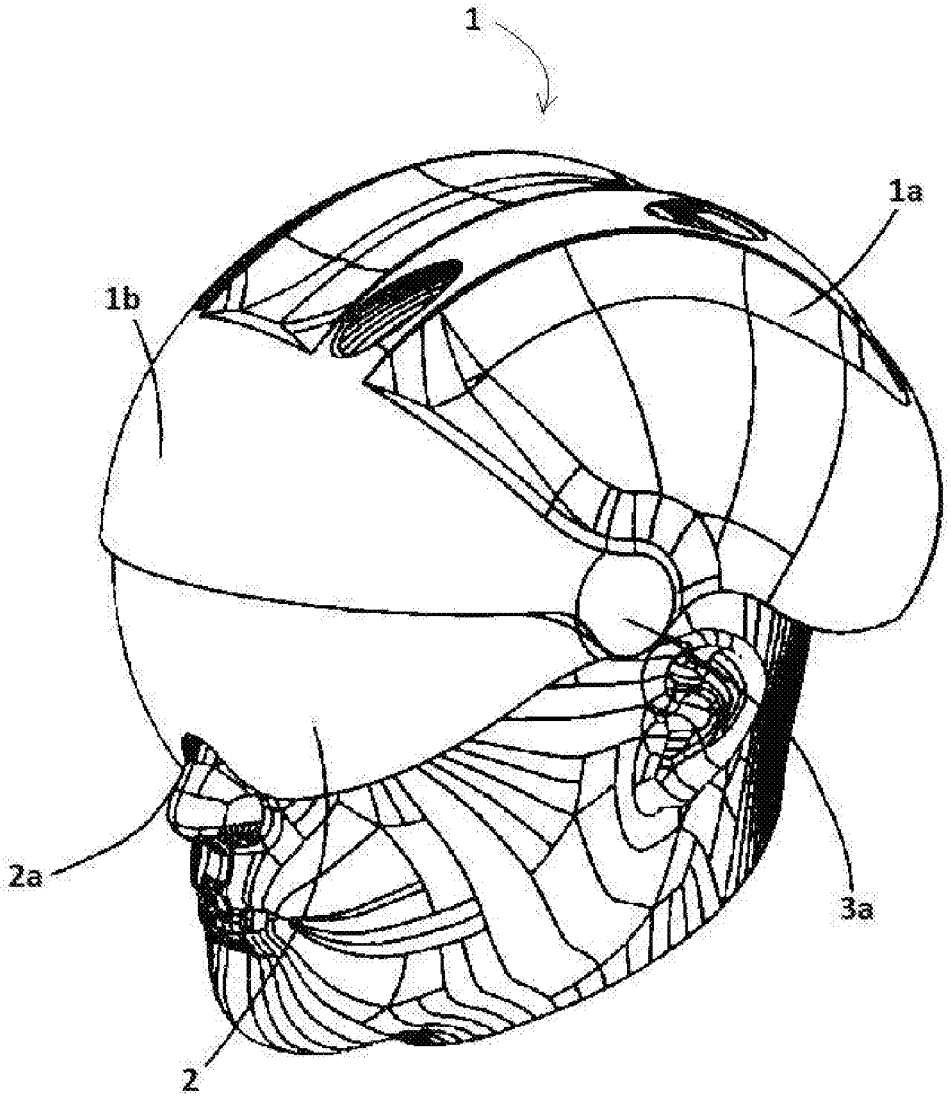
FIG. 2 is a perspective view of the helmet with the visor in the operable state.

Referring firstly to FIGS. 1 and 2, there is shown a helmet 1 having a rigid outer shell 1*a*. A visor 2 is attached to the shell at a first connection point 3*a* and a second connection point 3*b*, wherein the second connection point 3*b* is diametrically opposed to the first connection point 3*a*. The connection points are a pivot point, for example a hinge. The visor 2 is moveably attached to the shell at the connection points 3*a*, 3*b*.

Figure 3A:
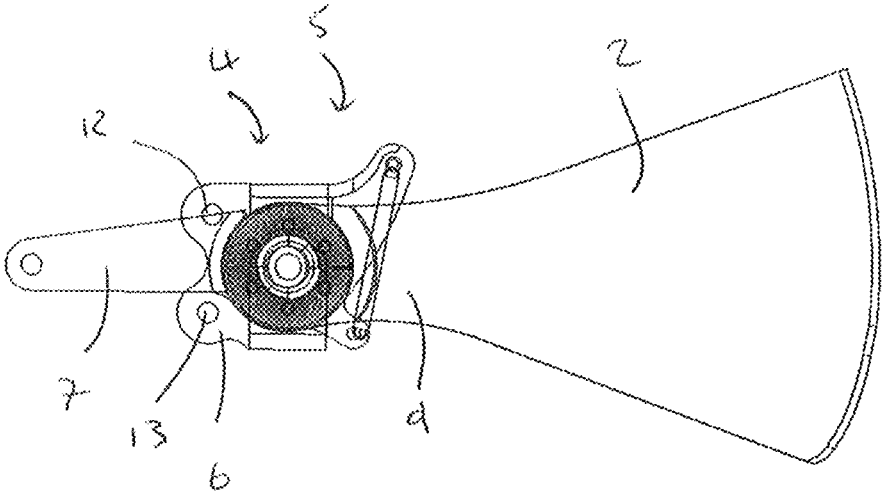
FIG. 3*a* is aside view of the mechanical components of the hinge of the visor with the visor in the operative position.
Figure 3B:
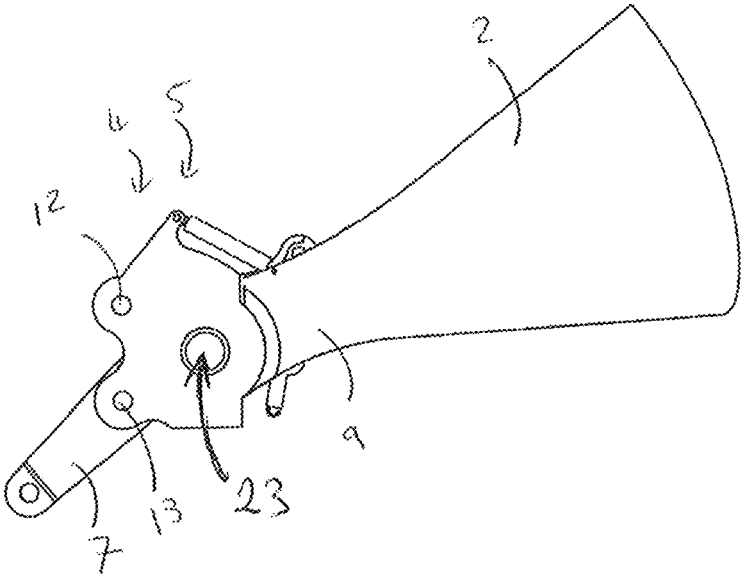
FIG. 3*b* is a side view of the mechanical components of the hinge of the visor with the visor in the stored position.
Figure 3C:
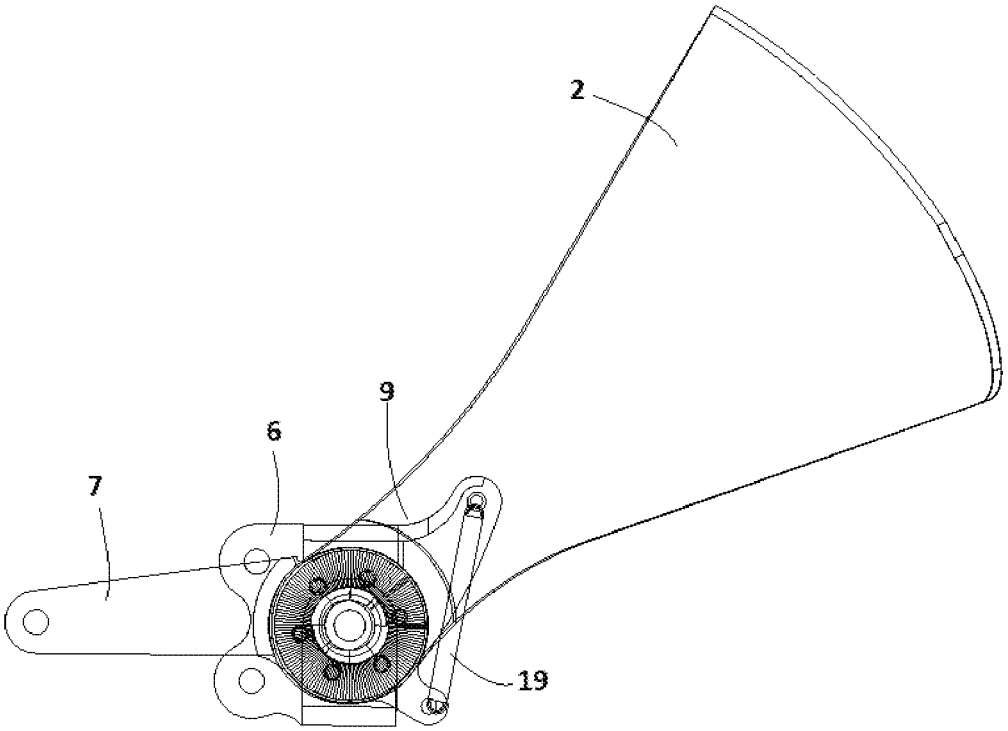
FIG. 3*c* is a side view of the mechanical components of the hinge assembly of the visor in the stored position with the override mechanism activated.

The shell 1*a* is dimensioned to receive the head of a wearer. Therefore, in use, the connection points 3*a*, 3*b* are disposed on either side of the wearers head. The visor 2 is configurable between a first position in which the visor 2 extends from a forward region 1*b* of the shell and a second position in which the visor 2 is substantially retracted with respect to the forward region 1*b* of the shell 1*a*. The visor 2 is pivotable about the hinged connection points 3*a*, 3*b* enabling the visor 2 to be slid between a first position as shown in FIG. 3*a* and a second position as shown in FIG. 3*b*. The shell includes a shield portion 1*b* that is fixed at the forward region of the shell and in the second position the visor is located behind the shield portion.

Actuation of the movement of the visor 2 between the first position and the second position is automated so as to provide an autoretract function of the visor 2 as the helmet 1 is removed from the user's head.

In the first position, the visor 2 is positioned in front of the eyes of the wearer and is in the operable state. The visor 2 is substantially transparent enabling the user to view therethrough. The visor 2 comprises a recessed edge 2*a* for defining the position of the nose of the wearer. The recess is designed to fit around or frame the nose so that the visor 2 effectively shields the eyes of the user, however it does not come into contact with the nose so as to minimise frictional effects that can cause sores.

On removal of the shell 1*a* from the users head, the visor is triggered to move from the first position to the second position.

Figure 4A:
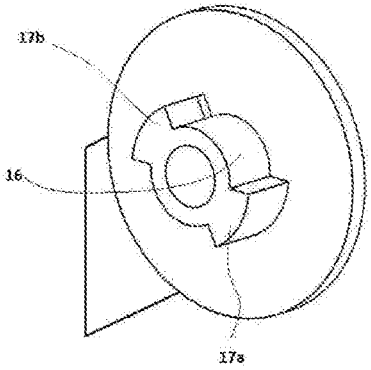
FIG. 4*a* is a schematic view of the recess located in a side wall of the automatic mechanism.
Figure 4:
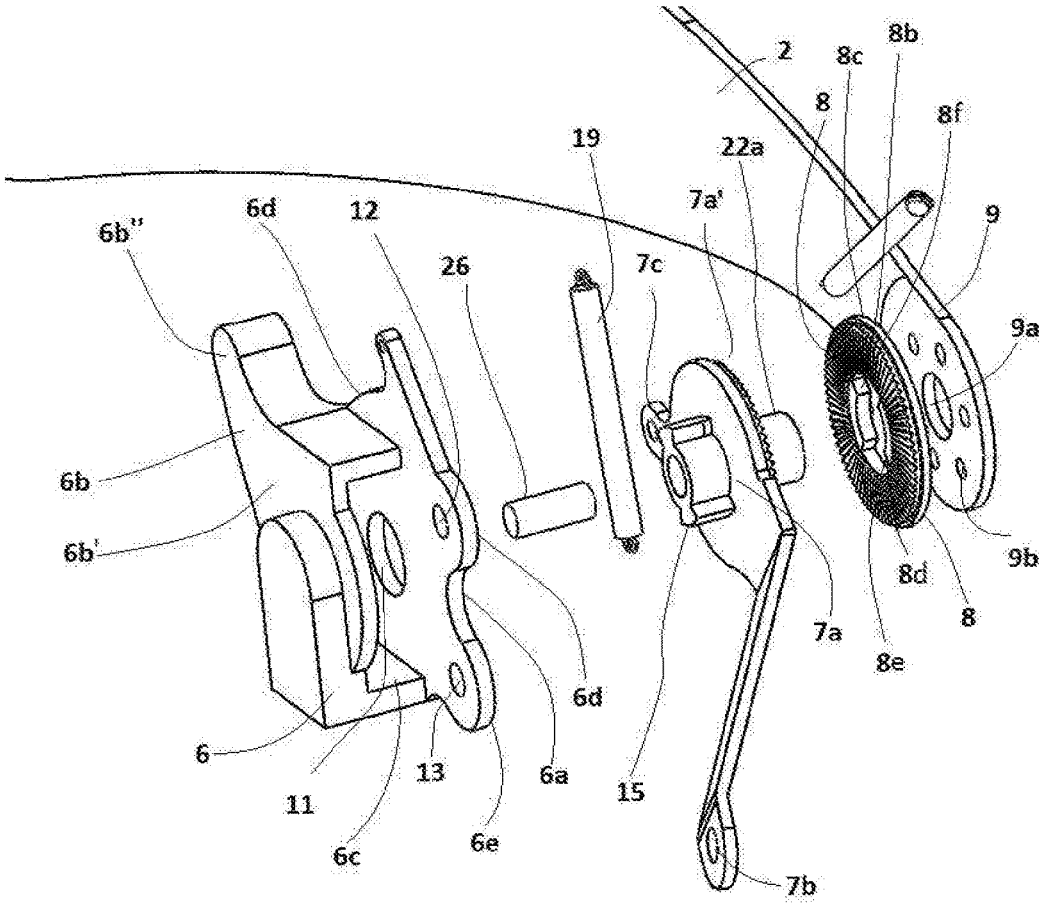
FIG. 4 is an exploded view of the mechanical components located at the hinge region of the helmet.
Figure 5:
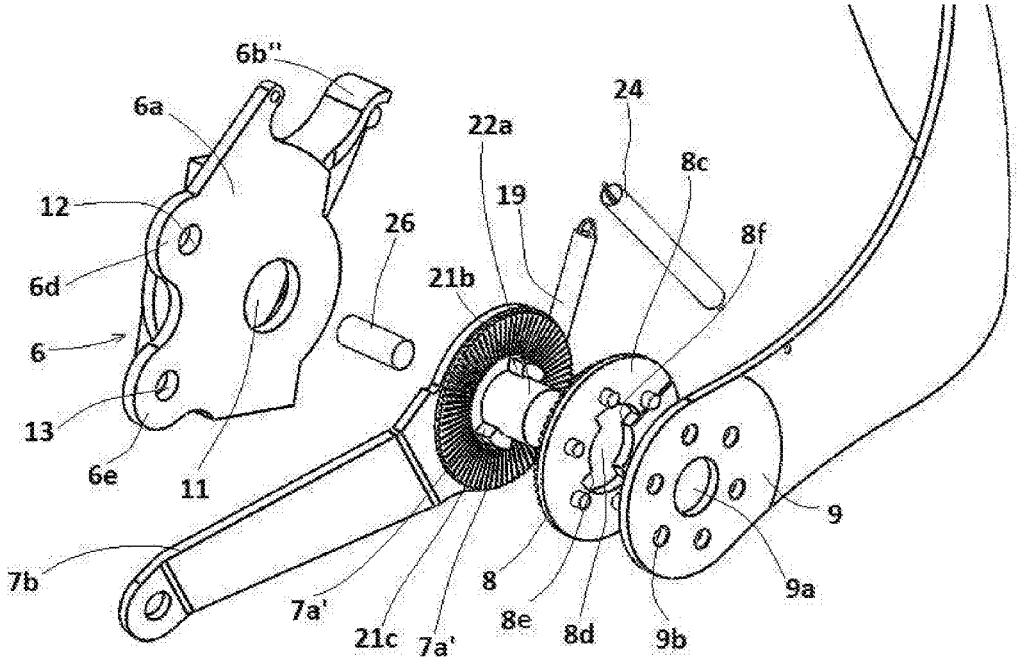
FIG. 5 is an exploded view of the mechanical components located at the hinge region of the helmet from an alternative angle.

A mechanical system 4 is provided to provide the automated movement of the visor 2 which is activated on removal of the helmet 1 from the head of the cyclist. The mechanical system 4 has a ratchet type arrangement as shown in FIG. 4 and FIG. 5.

Firstly considering only one of the diametrically opposed connection points 3*a*, a first connecting part 5 is attached to the helmet at the first connection point 3*a*. The first connecting part 5 is attached to the inside side edge of the helmet which is the part of the helmet that is positioned adjacent to the face of the wearer. The first connecting part 5 has several interrelating parts including a main body 6, a pivotable member 7, a locking member 8 and the connection portion 9 of the visor to be automated. The main body 6 is attachable to an interior portion of the helmet. Therefore the first connecting portion provides the first lockable hinge. Each of the parts of this lockable hinge are shown in FIG. 4 and FIG. 5.

The main body has a first side wall 6*a* and a second side wall 6*b* with a channel 10 arranged therebetween. The first and second side walls 6*a*, 6*b* have a connecting wall 6*c* arranged at opposing sides, for example to connect the top parts and the bottom parts of the main body 6. The first side wall 6*a* has a highly irregular shape having a first arcoidal side edge 6*d* or front edge and a rear edge having a lower and upper outwardly extending curved corner portion 6*e*, 6*f*, with a curved trough located therebetween. A circular aperture 11 is located at a substantially central portion of the first side wall 6. A second aperture 12 is located at the first (upper) curved corner region and a third aperture 13 is located at the second (lower) curved corner region.

The second side wall 6*b* is arranged substantially parallel to the first side wall 6*a* and has a main portion 6*b*' and an elongate portion 6*b*" that extends outwardly from the main portion 6. The elongate portion 6*b*" extends further than the side edge 6*d* of the first side wall 6*a*, however the connecting portion 6*c* is also located along the entire edge of the elongate portion 6*b*". On the internal surface of the second side wall 6*b* (which is the surface that faces towards the first side wall) there is provided a recessed portion 14. The recessed portion 14 is a female part mateable with a projecting portion 15 (or male part) of the pivotable member 7. The pivotable member 7 is moveably mated with the main body 6 such that the projecting portion 15 of the pivotable member 7 is locatable within the recessed portion 14 provided in the main body 6. The recessed portion 14 of the main body 6 is shaped to have a central cylindrical recess 16 from which radially extends a first and second recessed portion 17*a*, 17*b* having a cross section of a sector of a circle. The first and second portions are disposed diametrically opposite to each other.

The pivotable member 7 has a flat main body 7*a* comprising a central hub region from which extend a first elongate arm 7*b* and a small protrusion 7*c*. Both the elongate arm 7*b* and the small protrusion 7*c* have an aperture located towards their end region. The elongate arm 7*b* and the small protrusion 7*c* extend outwardly from the central hub 7*a* region in substantially opposite directions to each other.

Figure 6A:
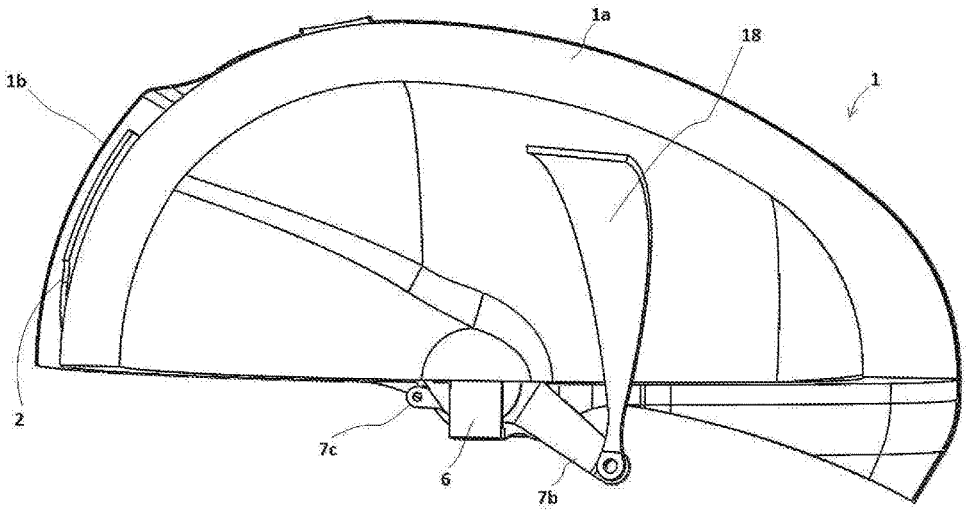
FIG. 6*a* is a schematic of the actuator of the automatic mechanism when the helmet is removed from the head of as user.
Figure 6B:
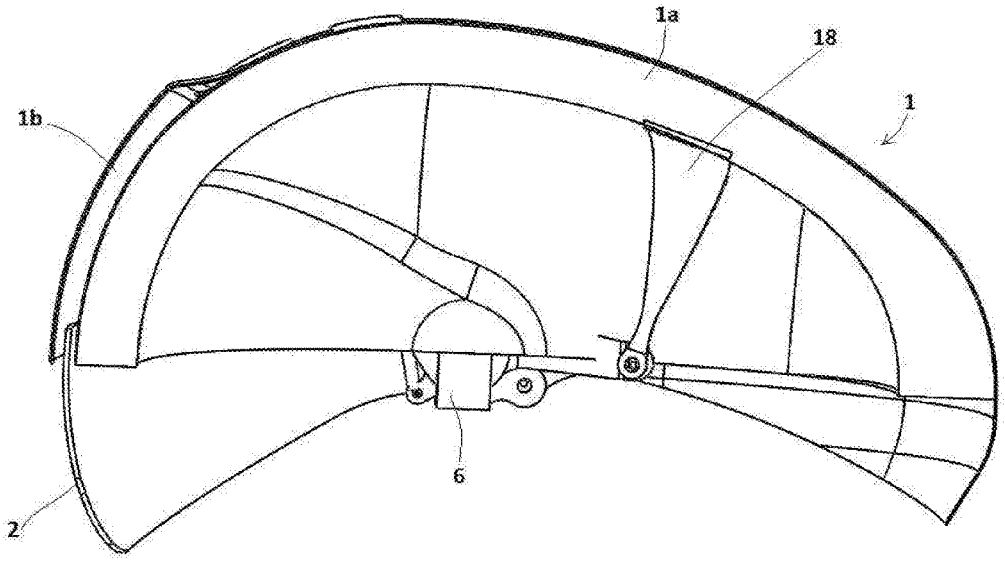
FIG. 6*b* is a schematic of the actuator of the automatic mechanism when the helmet is positioned on the head of as user (with the head omitted)

FIGS. 6*a* and 6*b* show that the end of the elongate arm 7*b* is attached to an actuator 18, for example a lever arrangement that is used to actuate the movement of the visor 2 when the actuator 18 is brought into contact with the users head. The small protrusion 7*c* of the pivotable member 7 is connected to one end of a resilient member 19, for example a helical spring. The other end of the helical spring is attached to the end of the elongate portion 6*b*" of the main body 6.

The projecting portion 15 of the pivotable member has a central cylindrical structure 20 from which radially extend first and second protuberances 21*a*, 21*b* that are shaped to fit within the first and second recessed portions 16, 17*a*, 17*b* of the main body 6. Therefore, each protuberance 17*a*, 17*b* has a sloped first and second side edge, which are sloped outwardly from each other and the protuberances 17*a*, 17*b* are terminated by an arc, thereby having a cross section resembling a sector of a circle. Therefore, the arc extends between the remote end of the first and second sloped edges. However, the length of the arc of the first and second protuberances 21*a*, 21*b* of the pivotable member 7 is less than the length of the arc of the first and second recessed portion 17*a*, 17*b* of the main body. This permits rotational movement of the pivotable member 7 with respect to the main body 6. The arc lengths are chosen to enable a 40 degree relative rotation between the pivotable member 7 and the main body 6. Therefore the pivotable member 7 controls the position of the visor 2 relative to the helmet 1 since the limits of the visor 2 can be set by the extreme's of the shaped male and female parts of the pivotable member 7 and the main body 6 respectively hinge position.

The pivotable member 7 is configured to move between a first pivot position and a second pivot position. In the first pivot position the first sloped side wall of the first and second protuberances 21*a*, 21*b* of the pivotable member 7 abuts the first side walls of the first and second recessed portion 17*a*, 17*b* of the main body. In the second pivot position, the second sloped side wall of the first and second protuberances 21*a*, 21*b* come into contact with the second sloped side wall of the first and second recessed portions 17*a*, 17*b* of the main body. The protrusion 15 of the pivotable member is therefore rotatable within the recess 14 and the side edges of the recess act as stops.

On the other side of the flat main body 7*a*, as shown in FIG. 5, there extends a second hub protrusion 22 comprising a hollow centred cylindrical portion 22*a* having a side wall at its remote end. from which radially extends a first and second angular portion 22*b*, 22*c* radially extend from the cylindrical portion 22*a*. Both the first and second angular portion have a cross section shaped like a sector of a circle. The first and second angular portions 22*b*, 22*c* are disposed diametrically opposite to each other. The cylindrical portion 22*a* extends past the remote end of the first and second angular portions 22*b*, 22*c*.

This cylindrical portion 22*a* is receivable within an aperture 9*a* located at the connection point 9 in the visor 2 and in the aperture located in the first wall 6*a* of the main body 6.

One side of the main body 6 is anchored to a surface of the shell 1*a*. The main body 6 is configured to hold all the parts that make the lockable hinge.

The resilient member 19, for example a helical spring is therefore configured to bias the visor 2 into the stored position (upwards position) when the helmet 1 has been removed from a cyclists head.

FIGS. 6*a* and 6*b* shows the actuator as a lever which is curved so as to follow the contour of the cyclists head in order to provide a comfortable fit. The remote end of the lever is located at the inner surface of the helmet such that it is positioned above and in contact with the cyclists head when the helmet is placed on the users head.

When the user places their head within the helmet 1 they make contact with the lever 18 causing it to be displaced towards the inner surface of the helmet causing the elongate portion 7*b* of the pivotable member 7 to move anticlockwise by 40 degrees. As a result the visor 2 is moved to the down position.

On the side of the pivotable member 7 from which is positioned closest to the visor the surface of the disc 7*a* is formed of an array of peak and trough regions 7*a*' formed on one planar surface thereof so as to form a first ratchet plate. The longitudinal axis of each peak and trough extends radially and is therefore configured to extend between the central region of the disc 7*a* (inner region) and the outer circumference of the disc (the outer edge). The peak region may be formed of an elongate tooth, whereby each of the side edges of the teeth on the first side of the apex are sloped in a common direction and the side edges of the teeth on the other side of the apex are sloped in a common direction. The teeth are therefore symmetric in form with equal angles on each side of the teeth. This enables the visor 2 to be moved or forced open with the hand if needed, which can protect the components from breaking due to exceeding the maximum design force. The visor can be moved up and down by pressing on a release button located at the central of the hinge of the visor as will be described in details later.

The locking member 8 comprises a second ratchet plate that is configured to engage with the disc of the pivotable member 7 such that when the pivotable member 7 rotates so to does the locking member, which is the second ratchet plate.

This locking member 8 is an annular disk 8*a* having an array of peak and trough regions 8*b*, 8*c* formed on one planar surface thereof. The longitudinal axis of each peak and trough extends radially and is therefore configured to extend between the aperture edge (inner edge) and the outer circumference of the ratchet plate (the outer edge). The peak region may also be formed of an elongate tooth, whereby each of the teeth in the array have sloped edges such that the teeth are therefore symmetric in form.

The first ratchet plate and the second ratchet plate, i.e. the disc 7*a* of the pivotable member and the locking member 8*a* are arranged face to face and in contact with each other such that in a locked state the apex of a tooth on the first plate is receivable in a recess between adjacent teeth of the second plate. The other surface of the second plate (i.e. that which faces away from the pivotable member) is formed with cylindrical protrusions 8*c* spaced radially and receivable in apertures 9*b* located on the connecting portion 9 of the visor 2. The centre of the second ratchet plate is provided with a central aperture 8*d* with the radially extending sector portions 8*e*, 8*f* at diametrically opposite positions. Therefore a second female portion is provided similar to that located in the second wall 6*b* of the main body. The outer arc of the sector portions are greater than that of the outer arc of the protrusions on the pivotable member.

The cylindrical part of the main body 22*a* forms the release button 23. When the release button 23 is pressed, the surface of the pivotable member 7 is moved away from the surface of the lockable member 8 (or at least the force between the two surfaces is reduced) and the visor 2 can be moved by hand so as to cause rotation of the pivotable member 7 in a first or second direction as desired such that the teeth of the second ratchet plate move over the teeth of the first ratchet plate until the teeth apices are passed and the apex of a tooth on the second plate is located within a recess between a first and second tooth on the first plate (and vice versa). This arrangement reduces the risk of breaking the mechanism if the ratchet is forced beyond its limit against the teeth.

The pivotable member 7 can be considered to be a driver and the lockable part 8 the follower. This is because the interface between the first and the second plate causes the lockable part 8 to follow the movement of the pivotable part 7 when they are engaged. When the visor 2 is in the first and second position the first and second ratchet plates (i.e. the corrugated surface of the pivotable member 7 and the corrugated surface of the lockable member 8) are locked together and the visor is located dependent on the position of the pivotable part. The default positions can be overridden when the release button 23 is pressed and the pivotable member 7 and the lockable member 8 disengage permitting the user to move the visor by hand in the required direction e.g. when the helmet is on the users head and the visor is automatically brought in front of the eyes of the user, the user can press the release button and move the visor up by hand to the stored state. The user can then restore the button 23 and the corrugated teeth on the pivotable member and the lockable member will once again engage and the visor will remain in the desired configuration.

To move the visor down again, the user can then press the release button a second time to once again disengage the corrugated surfaces of the pivotable part 7 and the lockable part 8 and the visor 2 can then be pulled down by hand.

Figure 7:
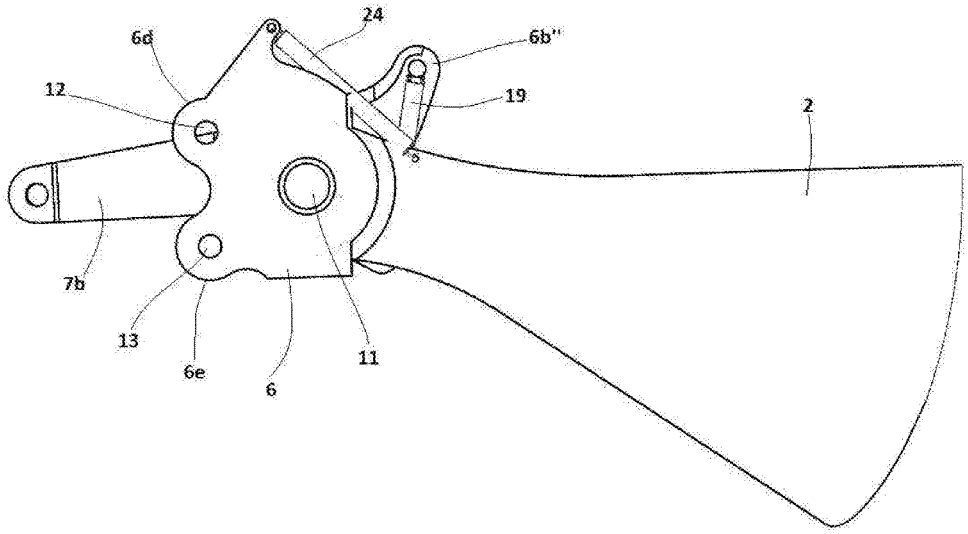
FIG. 7 is a side view of the mechanical components of the hinge region displaying the second spring.

Alternatively, a second resilient member 24 for example a second spring may be arranged between the visor 2 and a portion of the main body 6 or the interior of the helmet. This second spring 24 is shown in FIG. 7 and causes the visor to retract when the push button is pressed. Therefore, when the interlocking faces between the pivotable portion and the locking member are spaced apart the second spring causes the visor to move into the stored state, regardless of the fact that the user is still wearing the helmet.

A third spring 26 is located within the hollow cylindrical portion 22 and one edge of the spring abuts the internal wall of the main body 6 and the other end of the spring abuts the end of the end wall of the cylindrical portion 22 *a*. Therefore the third spring 26 is configured to cause the corrugated surface of the pivotable member 7 and the corrugated surface of the lockable member 8 to be biased towards each other so as to interface and provide a locking effect. When the user presses the push button the disc part 7*a* of the of the pivotable member 7 resists the biasing direction of the third spring and disengages with the corrugated surface of the lockable member 8.

The connection point of the visor 2 comprises a central circular aperture 9*a* and a series of circular apertures 9*b* arranged coaxially at spaced intervals around the central aperture 9*a*.

The central aperture of the visor receives the cylindrical protrusion 22*a* (which can also be considered as a boss) of the pivotable member 7, with the lockable member 8 sandwiched between the pivotable member 7 and the connection portion of the visor 9.

Therefore, in summary the visor 2 is automatically biased in the stored state by means of the first spring 19 located on the forwardly positioned elongate arm 7*d*. When the helmet 1 is placed on the head of the cyclist, the remote end of the lever 18 comes into contact with the cyclists head and causes rotation of the pivotable member 7 with respect to the main body. Rotation of the pivotable member 7 caused rotation of the lockable member 8 which is connected to the connection portion 9 of the visor 2. Therefore the visor 2 is caused to move into the down position where it remains while the lever 19 is in the up position. If the cyclist chooses to retract the visor 2 when they are wearing the helmet 1 they can apply the override mechanism described above. This removes the compressional force applied to the surface of the pivotable member 7 by the lockable member 8. This then enables the user to apply a force so as to allow the teeth of the pivotable member 7 to move over the teeth of the lockable member 8. When the visor 2 is in the stored state and the release button 23 unpressed, the lockable ratchet plate 8 will engage once more by the pivotable member 7. To subsequently close the visor 2, when the equal angle edge method is used, the button located at the hub region must be pressed to enable the visor to be moved downwards by hand.

When the user has finished with the helmet 1 they can remove it from their head and the force applied to the lever 19 will be removed and the pivotable part 7 will restore the position of the lever 18 back to its initial position causing the pivotable member 7 to move, the lockable member 8 to follow that movement and the visor 2 to be configured in its stored state.

The retraction control hinge 4 is applied at the first connection point 3*a* and the second connection point 3*b*.

Therefore, the second connection point 3*b* may be configured as described above with respect to the first connection point 3*a*. However, the mechanism located at the first connection point 3*b* will contain a stronger third spring 26 than that at the second connection point 3*b*, hence a stronger force is applied between the corrugated surface of the pivotable member 7 and the corrugated surface of the locking plate 8 at the first connection point 3*a* to move the visor from the stored position to the operable position, and the third spring 26 at the second connection point 3*b* is instead used as a supporting role to prevent the visor 2 from shaking when riding. The visor at the second connection point 3*b* is therefore able to rotate at a much lower force than the right side, and only the button located at the first connection point 3*a* must be pressed as an override mechanism to move the visor 2. This enables the user to keep hold of the handlebar with one arm whilst adjusting the visor's 2 position.

When the pivotable member 7, the locking member 8 and the visor 2 are configured together they can be placed within the channel 10 of the main body 6. This arrangement offers protection of the mechanism and ensures that the override function is only applied when the button at the hub or connection point 3*a* or 3*b* is pressed.

Figure 8:
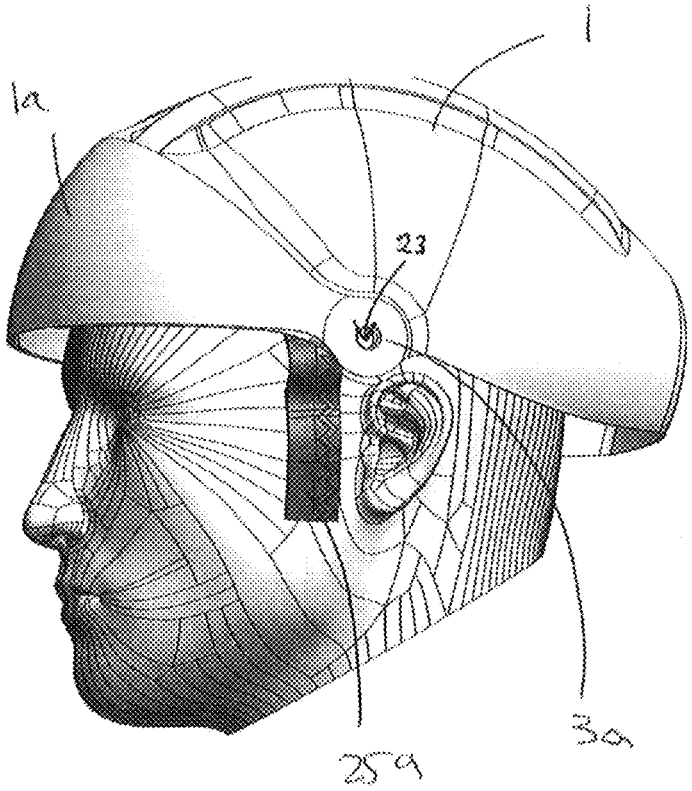
FIG. 8 is a perspective view of the helmet on the head of a user with the override mechanism activated and the stabilising members included.

As shown in FIG. 8, the helmet 1 also includes a first stabilising arm 25*a* and a second stabilising arm 25*b* that extends downwardly from the helmet 1 and, in use, the arms are positioned to be either side of the cyclists head, such that the support arms 25*a*, 25*b* are located at a position in front of the cyclists ears. The arms therefore act to stop wind and traffic noise, whilst maintaining the cyclists aural capability. The first and second stabilising arms 25*a*, 25*b* are made from a plastic exterior portion, but include a foam portion applied to the surface of the stabilising arm which is directed towards the user. This arrangement reduces air seeping between the arm and the user's face and offers extra support to the head of the user. The profile of each arm 25*a*, 25*b* is configured to follow the contour of the user's face in this region. The stabilising arms 25*a*, 25*b* are configured to take into account the usual 10-30 degree angle near the centre of the ear canal, looking form the front of the user. The outside surface of the stabilising arms have a patterned or rough edge to act as turbulence generators in order to mix the air before it is passed the user's ear. This beneficially increases the air turbulence and reduces the volume of wind noise transmitted into the ear canal. The first and second support arms 25*a*, 25*b* are an integral part of the helmet 1. The chin straps of the helmet are passed behind the stabilising arms 25*a*, 25*b* or through a machined channel provided in the stabilising arms 25*a*, 25*b*. It is important that the provision to have a path for the helmet strap to pass through the stabilising arms 25*a*, 25*b*, without obstructing in the performance of the noise reducing stabiliser.

The stabilising arms 25*a*, 25*b* are provided with gaps (not shown) or passages located perpendicularly to the longitudinal axis of the arms enabling users to wear sunglasses or normal glasses as required. This is either a hole for the glasses to fit through, or a curvature in the design of the stabilising arm so that it avoids the area near the stem of a pair of glasses.

In a second embodiment of the invention the stabilising arms 25*a*, 25*b* are configured to cause disengagement between the pivotable part and the locking member 8. Therefore the arms 25*a*, 25*b* act as the actuator for the release mechanism enabling movement of the visor 2, for example the stabilising arms 25*a*, 25*b* can be rotated, for example outwards to actuate release of the ratchet system.

Figure 9:
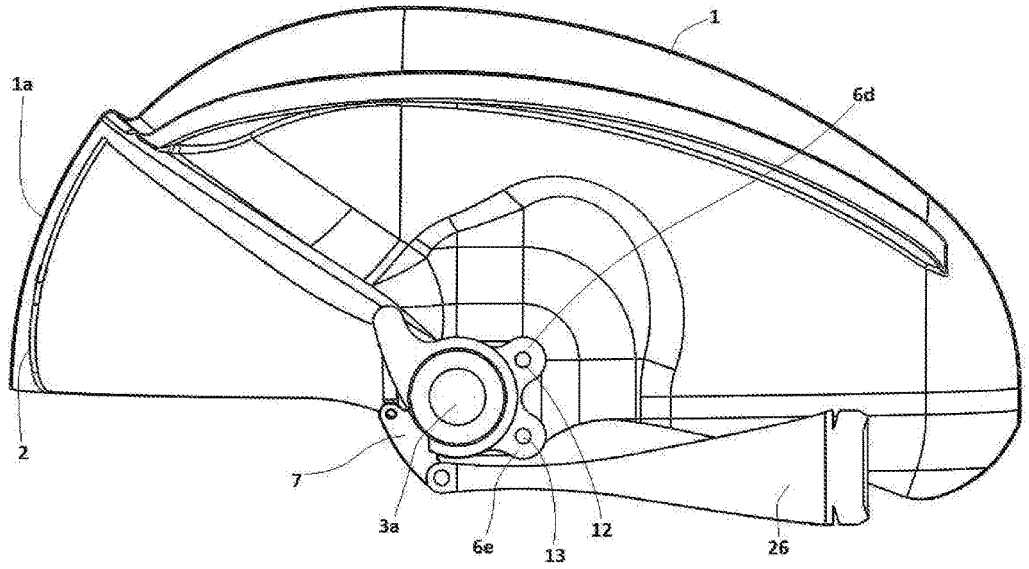
FIG. 9 is a side view of the helmet with a back strap as an actuator.

In a third embodiment of the invention as shown in FIG. 9, a rear strap 26 may be implemented as the actuator instead of the lever 18 to actuate the automated movement of the visor 2. The same principle would apply, whereby on insertion of the users head in the helmet, the strap would be moved towards the interior of the shell 1*a*, this time rearwardly of the users head, and would be mechanically linked to the pivotable member 7 so as to cause rotation of the pivotable member 7 and to mechanically communicate this rotation to the visor via the lockable member 8 thereby causing the visor 2 to be moved in front of the user eyes. Similarly, on removal of the helmet, the rear strap 26 would move away from the inner surface of the shell 1*a* and the pivotable member 7 would return to its original pivot position and the visor 2 would automatically move towards the stored state.

The time taken for the visor 2 to move from the first position to the second position is adjustable, therefore the speed of movement of the visor 2 can be controlled via the type of spring used. The actuator is located within the shell so as to maximise the aerodynamics of the helmet.

The visor 2 is made from polycarbonate and comprises a layer of glass on the outer surface of the visor. The external surface of the glass layer comprises a hydrophobic coating. The glass layer is thin and is applied to improve the application of the hydrophobic coating on the visor 2. Use of the hydrophobic coating improves the wearer's visibility in wet conditions since the water is encouraged to bead off of the surface of the visor due to the hydrophobic coating.

Alternatively, the hydrophobic coating is provided directly onto the surface of the polycarbonate visor 2. In this embodiment of the invention there is no glass layer provided.

Light waves can oscillate in more than one orientation and this property is known as polarisation. Therefore, light that is reflected from surfaces such as a road is horizontally polarised and our eyes view this horizontally polarised light as glare. To reduce the glare observed by the cyclist, the visor has polarising filters either provided by a coating applied to the surface of the visor, or the filtering can be provided by the material used for forming the visor itself. The filter minimises the amount of glare reaching the user's eyes and provides a clear and crisp image.

An LED light (not shown) is positioned at the rear and/or forward region of the helmet 1 and is provided to enable traffic to better see the cyclist.

The method of manufacturing the helmet 1 comprises forming the shell of the helmet 1 out of plastic using for example a 3D printing technique or more traditional manufacturing methods such as injection moulding. The helmet 1 can also be made from carbon fibre as the external surface of the shell. The EPS will then be injected on the inside of the shell in a specially made internal temporary mould. A shielding portion will then be applied to the forward region of the shell and the visor will be arranged between the external surface of the shell and the inner surface of the shielding portion. The lockable hinge system will then be attached to the internal surface of the helmet and the connection portion of the visor is connected thereto.

The helmet 1 is also provided with a vent arrangement (not shown) that allows the passage of air through the helmet past the head of the cyclist.

Various modifications to the principles described above would suggest themselves to the skilled person. For example, the main body 6 of the hinge system 4 may be an integral part of the shell 1*a*.

The autoretract feature may instead be triggered by undoing the strap of the helmet 1 and including a time delay between undoing the strap and commencement of the retraction process. So that the user can remove the helmet safely without getting caught from the trigger.

The visor need not be retracted within the shell and may instead be retracted to a position above the shell, and within a pocket region positioned adjacent to the outer edge of the shell.

In an alternative embodiment there is provided a retrofittable visor to be applied to an existing helmet. The visor with the autoretracting hinge may be applied to existing helmets as can the shield portion. A clip portion may be included to secure the visor onto a helmet that does not already contain a visor with an autoretracting hinge.

Movement of the visor between the first position and the second position may alternatively be provided by a hydraulic mechanism. Therefore the hydraulic mechanism would act as a biasing member and would actuate the automatic retraction of the visor. In the second state the visor may be retracted within the rigid shell in a stored position so as to protect the surface of the visor.

Alternatively the actuator is located on an external surface of the helmet for example may be a slideable switch, although this would be detrimental to the aerodynamics of the helmet.

In an alternative embodiment an electric sensor is provided for, in use, sensing whether the head of a user is received by the rigid shell. The sensor has a first output state corresponding to the head of the user being fully received by the shell and a second output state corresponding to the head of the user being partially received by or remote from the shell. Fully received by the shell means that the shell of the helmet is placed in contact with the users head so that it is retained in position thereon as would usually be expected of a person wearing a helmet.

'Partially received' occurs when the helmet is in the process of being removed or put on. The users head may be part way within the helmet, but there is no contact between the internal surface of the helmet and the users head.

The sensor may be a pressure pad, or alternatively an optical sensor. In the case a pressure pad is used, in the first output state pressure is applied to the pressure pad as the user's head comes into contact with the pressure pad and in the second output state no pressure is applied to the pressure pad since the user's head is no longer in contact with the pressure pad.

A biasing member is configured to bias the visor in the second position when the output of the sensor is in the second output state.

Alternatively, the teeth of the pivotable member or the lockable member are asymmetrical and may be offset in the same. In this modified configuration, the teeth of the second plate are able to move over the moderate slope of the teeth on the first plate, and a spring causes the apex of the tooth on the second plate to fall into a depression located at the interface region (the trough) positioned between teeth located on the first plate once a tooth has been passed.

However, when the pivotable member is caused to move in the second direction which opposes the first direction, the tooth apex comes into contact with the steeply sloped side edge of a tooth of the first plate and prevents movement of the pivotable part in the second direction, thereby providing a stopping effect in the second direction. Therefore, a ratchet arrangement is provided. Instead of a second ratchet plate the invention may be configured with a single protrusion, for example a pawl as per a standard ratchet and pawl arrangement.

In an alternative design the teeth of both the first and second plate have a slightly unequal slope rather than an identical slope and the release button will still need to be depressed to enable movement of the visor in the first and second direction.

The first and second elongate arms of the pivotable member may extend outwardly from the central hub region in any direction.

The automated retraction of the helmet as described may be applied to any type of helmet, for example a motorcycle helmet.

In an alternative embodiment of the invention the main body is formed of two halves that come together in a snap fit, or are retained by screws, or other attachment means. Therefore the mechanism comprising the pivotable portion, the locking plate and the end of the visor may be placed easily within the main body and retained in position as the two parts of the main body are brought together.

Alternatively to providing the third spring of different relative strengths, the corrugation on the surface of the pivotable member 7 and/or locking member 8 may be sloped to permit movement in a first direction as per a standard ratchet arrangement.

What is claimed is:

1. A helmet for placement on the head of a user, the helmet comprising: a shell dimensioned to receive the head of the user; a visor moveably attached to the shell, and configurable between (1) a first position in which the visor extends from a forward region of the shell and (2) a second position in which the visor is retracted with respect to the forward region of the shell, an actuator coupled to the shell and visor;

wherein the actuator extends to an upper region of the shell, such that the actuator is positioned between the head of the user and the shell when the helmet is placed on the head of the user;

wherein the actuator is configured to (1) move the visor between the first position and the second position is as the helmet is being removed from the head of the user, and (2) move the visor between the second position and the first position as the helmet is being placed on the head of the user; and wherein the actuator is located internally to the shell and moveable between a first configuration where the head of the user is remote from the shell and a second configuration where the head of the user is received by the shell such that contact is made between the actuator and the head of the user to move the visor from the second position to the first position.

2. A helmet according to claim 1, wherein the visor further comprises a shield portion located at the forward region of the shell for providing a shielding effect to an outer surface of the visor when the visor is in the second position so as to protect the outer surface of the visor.

3. A helmet according to claim 1, wherein the actuator is shaped to follow the contour of at least a portion of the user's head.

4. A helmet according to claim 1, wherein in use the user's head comes into contact with the actuator and the resulting force applied thereto causes the actuator to move towards an inner surface of the shell thereby reducing a distance between the actuator and the inner surface of the shell.

5. A helmet according to claim 1, wherein the actuator is in mechanical communication with the visor such that movement of the visor occurs in response to movement of the actuator between the first and second configuration or vice versa.

6. A helmet according to claim 1, further comprising a biasing member configured to bias the actuator in the first configuration when the head of the user is removed from the shell such that the visor is biased in the second position.

7. A helmet according to claim 6, wherein one end of the biasing member is mechanically connected to the actuator and the other end of the biasing member is mechanically connected to the shell.

8. A helmet according to claim 1, wherein the visor is attached to the shell at a first pivot point and a second pivot point, the first pivot point being spaced apart from the second pivot point such that in use the first pivot point and the second pivot point are positioned on either side of the head of the user.

9. A helmet according to claim 8, wherein at the first and/or second pivot point there is configured a lockable hinge system, the lockable hinge system comprising a pivotable part and a cooperable locking member.

10. A helmet according to claim 9 wherein the lockable hinge system further comprises a main body attachable to the shell for securing the visor, pivotable part and the locking member.

11. A helmet according to claim 10, further comprising the lockable hinge system being configurable to permit a rotational movement of the visor within a predetermined range.

12. A helmet according to claim 9, wherein the locking member and the visor are attached together by at least one protrusion located on the locking member and at least one aperture or recess located on a connecting portion of the visor, or vice versa.

13. A helmet according to claim 9, further comprising an override mechanism comprising a resilient member arranged between the pivotable part and the locking member, the override mechanism being configurable between a first state in which the surfaces of the pivotable part and the locking member are brought together and a second state in which the surfaces of the pivotable part and the locking member are arranged to permit relative movement between the locking member and the pivotable part.

14. A helmet according to claim 13, further comprising a release button for selecting between the first state and the second state.

15. A helmet according to claim 1 wherein the helmet comprises a first and a second support arm configured to be positioned forwardly of a user's ears to thereby block wind and noise incident on the user's ears.

16. A helmet according to claim 15, wherein an outside surface of at least the first support arm has a patterned or rough edge so as to act as air turbulence generators prior to air reaching the user's ears.

* * * * *